United States Patent [19]

Donahue

[11] 4,285,270

[45] * Aug. 25, 1981

[54] PAINT SPRAY BOOTH WITH FLOODED FLOOR

[75] Inventor: Joseph D. Donahue, Troy, Mich.

[73] Assignee: Schweitzer Industrial Corporation, Madison Heights, Mich.

[ * ] Notice: The portion of the term of this patent subsequent to Sep. 16, 1997, has been disclaimed.

[21] Appl. No.: 89,075

[22] Filed: Oct. 29, 1979

[51] Int. Cl.[3] ..... B05C 15/00

[52] U.S. Cl. ..... 98/115 SB; 134/104

[58] Field of Search ..... 98/115 R, 115 SB; 134/104; 119/28

[56] References Cited

U.S. PATENT DOCUMENTS

| | | | |
|---|---|---|---|
| 2,825,300 | 3/1958 | Carlson | 119/28 |
| 3,876,399 | 4/1975 | Saponaro | 98/115 SB |
| 4,045,524 | 8/1977 | Barnett | 98/115 SB |
| 4,063,565 | 12/1977 | Edwards et al. | 134/104 |
| 4,222,319 | 9/1980 | Donahue | 98/115 SB |

*Primary Examiner*—Albert J. Makay
*Assistant Examiner*—Harold Joyce
*Attorney, Agent, or Firm*—Krass, Young & Schivley

[57] ABSTRACT

A paint spray booth of the type having a forced air/water exchange for trapping paint overspray. A subfloor beneath the working area comprises a flat pan which is deeply flooded with water and plural central discharge tubes, the sides of which are raised above the subfloor to create a weir effect. Sludge troughs sunk into the subfloor are used to periodically drain the water from the pan and clean paint buildup from the subfloor.

8 Claims, 3 Drawing Figures

PAINT SPRAY BOOTH WITH FLOODED FLOOR

INTRODUCTION

This invention relates to paint spray booths and more particularly to a paint spray booth incorporating a flooded subfloor for the extraction of paint overspray and sludge troughs disposed across the subfloor at spaced intervals to facilitate draining anc cleaning of the subfloor.

BACKGROUND OF THE INVENTION

It is customary to spraypaint automobiles and other mass-produced articles in a spray booth having the physical characteristics of an elongated corridor or chamber through which the automobiles are longitudinally conveyed and within which a human operator or mechanical robot or a combination of same actuate paint spraying equipment. It is essential in the operation of a paint spray booth to maintain a proper supply of fresh air and to remove paint overspray by means of an air exhaust system.

It is known to remove paint overspray from the air by drawing the air through water flooded cylinders disposed along the center line of a subfloor within the booth at longitudinally continuous planes which slope toward the center line and which are flooded with a thin sheet of water which catches some of the paint overspray. A mixing action between air and water takes place within the spaced cylinders to catch the remaining paint overspray. Water flowing down through the cylinders drops into a disposal sluice which runs from the paint spray booth to a treatment center. Such a paint spray booth is disclosed in the U.S. Pat. to Halls No. 3,421,293.

My co-pending application Ser. No. 851,253 titled "Paint Spray Booth with Flooded Floor" now U.S. Pat. No. 4,222,319 issued Sept. 16, 1980 discloses an improved paint spray booth having a relatively flat flooded subfloor and a plurality of longitudinally spaced cylindrical or tubular outlet structures with means defining walls which extend above the subfloor to create a substantial depth of subfloor flooding, i.e., on the order of three inches, and to produce a weir effect. Other features include a simplified water delivery system comprising inlet conduits which extend upwardly through the subfloor from a supply conduit.

BRIEF SUMMARY OF THE INVENTION

The principal objective of the present invention is to improve upon the paint spray booth of my above-named copending application which exhibits the flooded subfloor system above described. More particularly, an objective of the invention is to provide a paint spray booth having a relatively flat flooded subfloor which is adapted to be more easily drained and cleaned of accumulated paint deposits as must be done periodically.

In general, the objectives set forth above are accomplished by providing a paint spray booth having a flooded subfloor and a plurality of longitudinally spaced cylindrical outlet structures, as described above and in further detail in U.S. Pat. No. 4,221,319, and further including a plurality of laterally running sludge troughs sunk into the subfloor and provided with drains which can be opened when it is desired to drain the subfloor for cleaning.

DETAILED DESCRIPTION OF THE SPECIFIC EMBODIMENT

Figure 1:
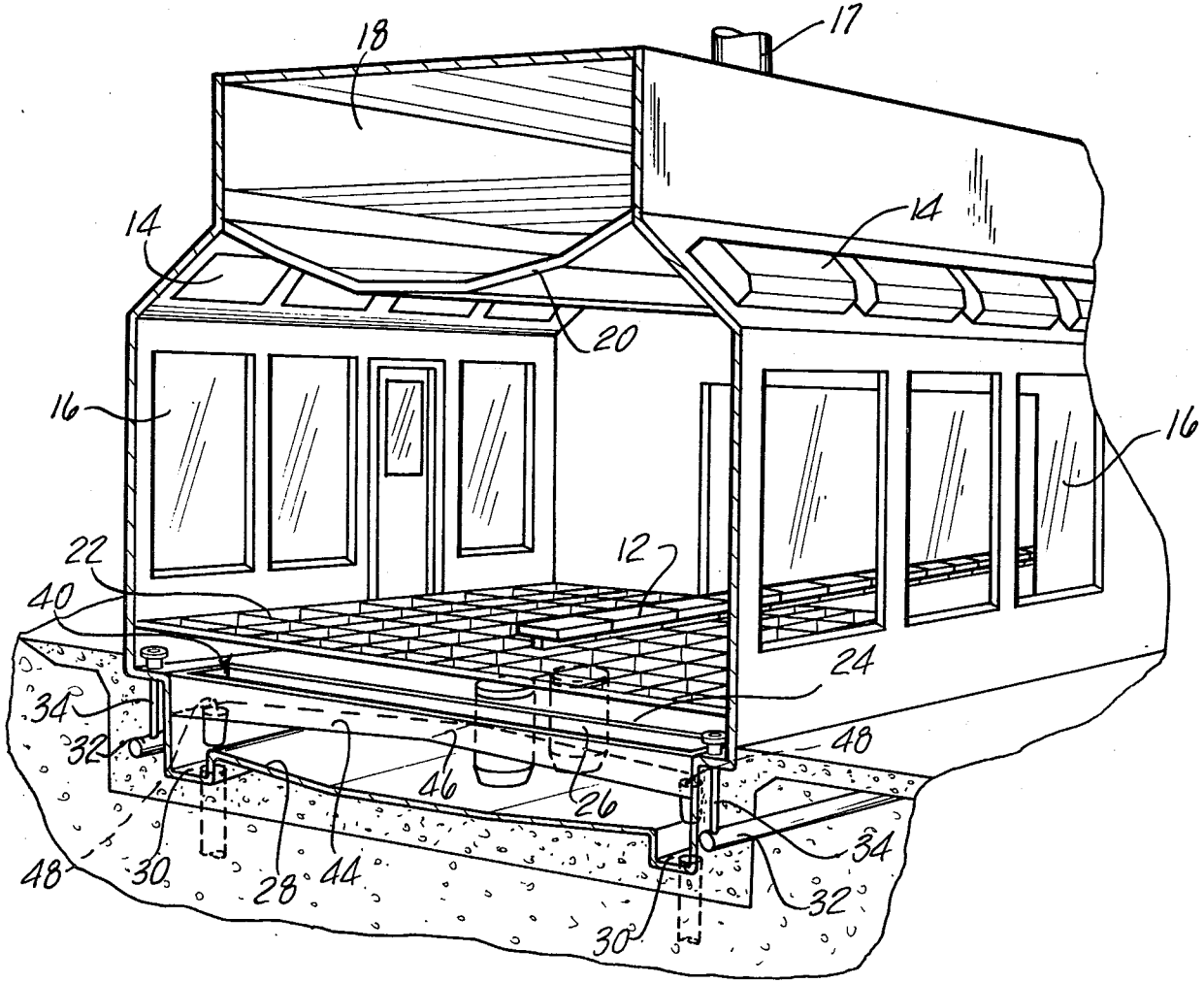
FIG. 1 is a simplified perspective drawing of a section of the paint spray booth.

Referring to FIG. 1, there is shown a paint spray booth for automobiles or other mass-produced articles and comprising an elongate housing structure 10 defining a large open interior area through which automobiles may be towed by means of a conveyor 12 and around which a human operator may move to spray paint on the automobile bodies as they pass longitudinally through the structure 10.

Lighting fixtures 14 are mounted overhead to illuminate the working area. In addition, windows 16 create an open, airy, and well lighted effect within the structure 10.

The atmosphere within the structure 10 is continuously refreshed in the manner described in the aforementioned patent to Halls, U.S. Pat. No. 3,421,293, i.e., air is pulled through supply stack 17 into a plenum 18 and thence through overload filter 20 into the work area. Exhaust air flows through a washing system as hereinafter described and thence to the outside.

The working floor is defined by a full width open grating 22. Disposed approximately 18 inches beneath the grating 22 is a water-flooded subfloor 24 constructed in the form of a deep pan having a substantially horizontal bottom surface and extending substantially entirely across the structure 10. Extending through and centrally of the subfloor 24 are a plurality of longitudinally spaced tubes or cylinders 26 which provide a scrubbing action on the exhaust air. As noted in FIG. 1 the cylinder sidewalls extend above the floor 24 by approximately three inches thereby creating a weir which results in a standing pool of water approximately three inches in depth when the subfloor is properly supplied. While the pool is substantially quiet, the weir effect creates a high flow speed in the immediate vicinity of the cylinders 26. Cylinders 26 are spaced above a trough-shaped base floor 28 which slopes laterally upwardly to both sides toward drain sluices 30. The sluices 30 on opposite sides of the base floor 28 convey paint laden water to a treatment plant not shown.

In operation, water stands on the floor 24 to catch heavy drops of paint which might fall through the grating 22. Water from the floor 24 overflows into the tubes 26 where high air flow rates create turbulence which mixes the air and water and results in an exchange of the paint overspray from the exhaust air to the water. The water, now laden with paint, falls into the trough formed by floor 28 from which it is caused to flow to a treatment facility. The clean air flows along the area beneath tubes 26 to an exhaust stack (not shown).

Figure 2:
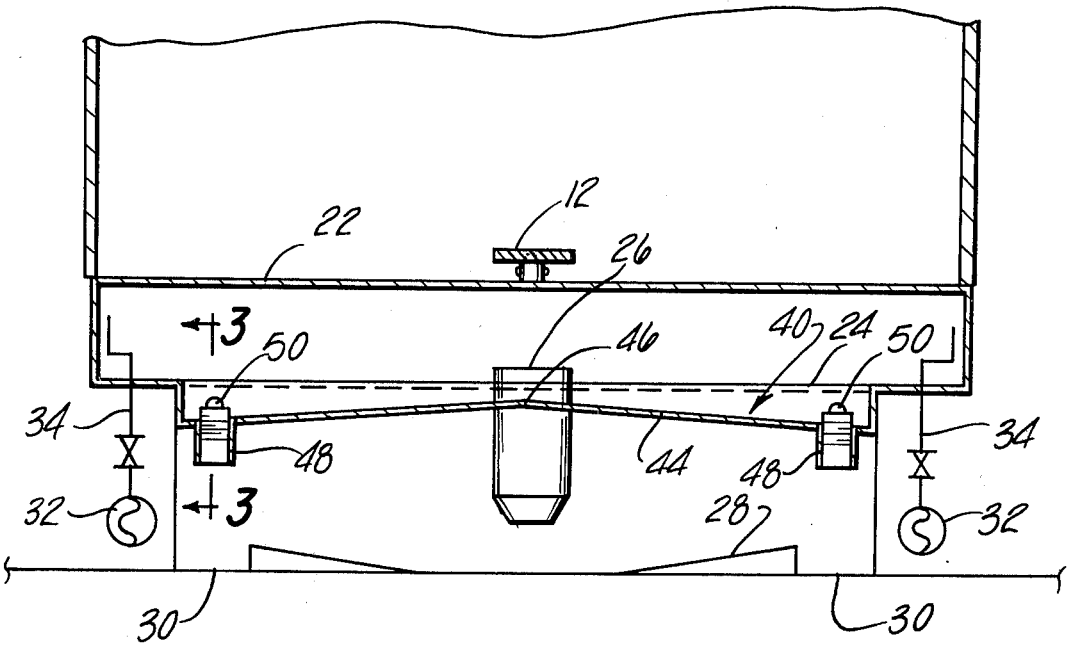
FIG. 2 is a cross-sectional drawing through the paint spray booth incorporating the features of the invention.

Water is supplied to the subfloor 24 by means of longitudinally extending conduit 32 having spaced vertically extending distributor legs 34 which extend upwardly through the subfloor as best shown in the left side of FIG. 1 and again schematically in FIG. 2. The paint spray booth as so far described is substantially that described in copending U.S. patent application Ser. No.

851,253 now U.S. Pat. No. 4,222,319 issued Sept. 16, 1980.

Figure 3:
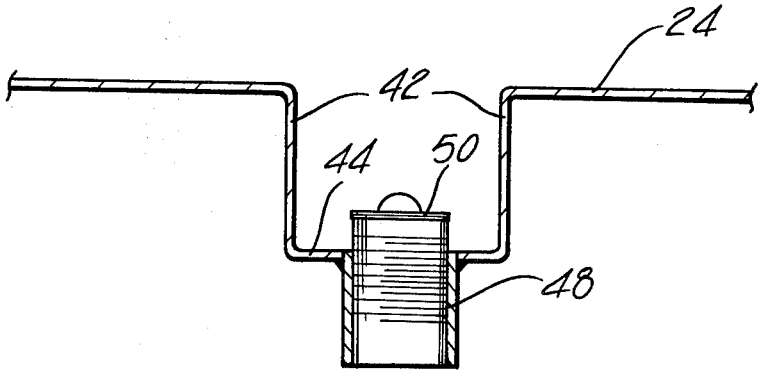
FIG. 3 is a cross-sectional view taken along line 3—3 of FIG. 2.

The improvement of the present invention takes the form of a plurality of depressed sludge troughs 40 which are formed in the subfloor 24 at intervals of twenty to fifty feet along the structure 10. Each sludge trough 40 extends laterally to the extreme outside edges of structure 10 so as to overlie sluices 30. Trough 40 is defined by sidewalls 42 and bottom 44. The trough 40 may be formed integrally with subfloor 24 as shown in FIG. 3. Trough bottom 44 is peaked at the center 46 and slopes downwardly to both sides to facilitate drainage when desired. At the outer ends of trough 40 are threaded cylindrical drains 48 which pass through trough bottom 44 and are located directly above sluices 30. Threaded plugs 50 are provided which engage with threads formed on the inside of drains 48 to achieve a water tight seal.

Clean-out is accomplished by shutting off the water supply from feeder pipes 34, unscrewing and removing threaded plugs 50 and allowing the water and sludge to drain out of drain tubes 48 into sluices 30. Any sludge remaining on subfloor 24 can then be scraped into sludge troughs 40 and washed down with a hose. In the preferred embodiments, the troughs 40 are spaced approximately every 40 feet along the length of the subfloor 24. The fact that the accumulated heavy paint deposits are kept under water until removal tends to substantially facilitate the removal operation described.

As wi,ll be apparent to the skilled artisan, the weir effect of tubes 26 may be created alternatively by means of parallel, and longitudinal wall pieces located laterally on both sides of the tubes 26 whereby the tubes may then be flush with the subfloor 24 or even depressed somewhat if desired. Vanes, water nozzles, baffles and/or plates may be disposed in or below tubes 26 to inhance turbulence for air cleaning purposes.

The embodiment of the invention in which an exclusive property or priviledge is claimed is defined as follows:

1. In a paint spray booth of the type comprising an elongate housing defining a working area, a perforate working floor, means for supplying air to the working area from overhead and for causing a flow of said air downwardly through the working floor, a flat subfloor spaced from and beneath the working floor, means for flooding said subfloor with water to a substantial depth, a plurality of longitudinally spaced discrete outlet structures in said subfloor through which air and water flow, and means beneath said subfloor for receiving and discharging paint-laden water from said outlet structures, the improvement comprising:

means defining at least one trough in the subfloor, said trough extending substantially laterally across the subfloor and having openings in the bottom thereof for draining and cleaning said subfloor, said openings being provided with closing means which close off said openings to prevent drainage except when desired.

2. Apparatus as defined in claim 1 wherein said troughs are substantially rectangular in cross section.

3. Apparatus as defined in claim 1 wherein the bottom of said trough slopes laterally.

4. Apparatus as defined in claim 3 wherein said highest point of said trough bottom is equidistant from the lateral extremes of said trough.

5. Apparatus as defined in claim 4 wherein said closing means are located substantially at the lateral extremes of said trough.

6. Apparatus as defined in claim 1 wherein said closing means are threaded plugs which engage with mating threads disposed in said openings to achieve a watertight seal therewith.

7. Apparatus as defined in claim 1 further comprising a water disposal way disposed beneath the subfloor and having sluices on opposite lateral extremes thereof, said trough openings being disposed directly over said sluices.

8. In a paint spray booth of the type comprising an elongate housing defining a working area, a perforate working floor extending substantially the full width of said working area, and means for supplying air to the working area from overhead and for causing a flow of said air downwardly through the working floor, a flat subfloor disposed beneath and spaced from said working floor, means for supplying water to said subfloor, means for damming the water to create a relatively calm pond of water on said subfloor, a plurality of outlet structures in said subfloor to receive water overflowing said damming means, means associated with said outlet structures for mixing paint laden air with water to cause paint suspended in the air to adhere to the water, water disposal means located beneath said outlet structures to receive water flowing downwardly therefrom as a result of overflow from said damming means on said subfloor and disposal sluices at opposite lateral extremes of said water disposal means, the improvement comprising:

means for draining and cleaning said subfloor including at least one trough in the subfloor, said trough extending substantially laterally across the subfloor and having openings in the bottom above said disposal sluices; and means for selectively closing said openings to prevent drainage therethtough.

* * * * *